US005647408A

United States Patent [19]

Erste et al.

[11] Patent Number: 5,647,408

[45] Date of Patent: Jul. 15, 1997

[54] AEROSOL CAN FILLING HEAD

[75] Inventors: Marijan F. Erste, South Eclid; Robert S. Beres, Rittman, both of Ohio

[73] Assignee: The Sherwin-Williams Company, Cleveland, Ohio

[21] Appl. No.: 615,560

[22] Filed: Mar. 12, 1996

[51] Int. Cl.[6] ..... B65B 1/04

[52] U.S. Cl. ..... 141/20; 141/350; 141/383; 141/67; 251/149.6

[58] Field of Search ..... 141/3, 20, 346, 141/348, 349, 350, 370, 372, 383, 386, 67; 137/614.05; 251/149.6, 149.7; 222/402.16

[56] References Cited

U.S. PATENT DOCUMENTS

| | | | |
|---|---|---|---|
| 2,009,400 | 7/1935 | Hapgood | 226/116 |
| 2,613,023 | 10/1952 | Reich | 226/100 |
| 2,747,775 | 5/1956 | Pritchard | 141/383 |
| 2,792,028 | 5/1957 | Henze, et al. | 141/97 |
| 2,989,993 | 6/1961 | Osmond et al. | 141/20 |
| 3,181,575 | 5/1965 | Krizka | 141/141 |
| 3,211,191 | 10/1965 | Honisch | 141/20 |
| 3,273,606 | 9/1966 | O'Neill, Jr. | 141/349 |
| 3,335,765 | 8/1967 | Moonan | 141/20 |
| 3,338,022 | 8/1967 | Moonan et al. | 53/36 |
| 3,444,906 | 5/1969 | Moonan et al. | 141/20 |
| 3,489,186 | 1/1970 | Riker | 141/141 |
| 3,589,410 | 6/1971 | Manas | 141/45 |
| 3,604,477 | 9/1971 | Grothoff | 141/20 |
| 3,620,266 | 11/1971 | Ryder | 141/20 |
| 3,797,534 | 3/1974 | Skidmore | 141/3 |
| 4,216,884 | 8/1980 | Giuffredi | 222/402.16 |
| 4,262,709 | 4/1981 | Mayfield | 141/67 |
| 4,538,659 | 9/1985 | Adelman, et al. | 157/1 |
| 4,938,260 | 7/1990 | Hirz | 141/20 |

FOREIGN PATENT DOCUMENTS

| | | | |
|---|---|---|---|
| 527973 | 4/1954 | Belgium | 141/277 |
| 527971 | 4/1954 | Belgium | 141/277 |
| 1256094 | 12/1967 | Germany | 141/275 |
| 304001 | 1/1929 | United Kingdom | 141/276 |

OTHER PUBLICATIONS

"Super Omni–Fill 100" Sherwin–Williams Advertising Brochure, no date available.

"Omni–fill New and Improved Mark III Pneumatic Filling System", Sherwin–Williams Advertising Brochure, no date available.

"Omni–Fill New Mark II Pneumatic Filling System", Sherwin–Williams Advertising Brochure, no date available.

*Primary Examiner*—Renee S. Luebke
*Assistant Examiner*—Steven O. Douglas
*Attorney, Agent, or Firm*—Steven W. Tan; James A. Hudak

[57] ABSTRACT

An adapter is disclosed for a can filling machine permitting the machine to be utilized to fill aerosol cans having a "female" type discharge valve. The adapter includes a fill head which is threadably attached to the paint reservoir of the can filling machine permitting the injecting piston of the can filling machine to be received within the working bore of the fill head. A valve engaging member is threadably attached to one end of the fill head and a spring therein biases a ball against a passageway in the bottom of the working bore. The other end of the valve engaging member has a "male" tip formed thereon which is received within the "female" type discharge valve in the aerosol can and depresses a valve body therein. Depression of the valve body within the "female" type discharge valve by the "male" tip of the valve engaging member permits paint within the working bore of the fill head to be injected into the aerosol can.

8 Claims, 3 Drawing Sheets

AEROSOL CAN FILLING HEAD

TECHNICAL FIELD

The present invention relates, in general, to apparatus for filling pressurized containers, such as aerosol cans, and, more particularly, to an adapter for apparatus for filling aerosol cans having a "female" type discharge valve.

BACKGROUND ART

When aerosol spray cans are utilized to dispense "custom" paint colors, it has been common practice to charge the cans with a propellent gas before sealing same and then later injecting the paint or lacquer into the can to satisfy an order for a "custom" paint color by utilizing some type of can filling apparatus, such as a pneumatically controlled aerosol can filling machine as disclosed in U.S. Pat. No. 4,938,260. The fill head or adapter utilized by the apparatus in the aforementioned patent is such that only aerosol cans having "male" type discharge valves can be filled. Thus, the apparatus disclosed in this patent cannot be utilized to fill aerosol cans having "female" type discharge valves, the use of which is increasing in the industry.

Because of the increasing demand for aerosol cans which can spray "custom" paint or lacquer colors, and the increasing use of "female" type discharge valves on such aerosol cans, it has become desirable to develop an adapter which can be utilized by a can filling machine, such as that disclosed in U.S. Pat. No. 4,938,260, for filling aerosol cans having "female" type discharge valves.

SUMMARY OF THE INVENTION

The present invention solves the problems associated with the prior art and other problems by providing an adapter for a can filling machine permitting the machine to be utilized to fill aerosol cans having a "female" type discharge valve. The adapter includes a housing or fill head which is threadably attached to the paint reservoir of the can filling machine so that the working bore of the fill head is aligned with the paint injecting piston within the filling machine. The working bore contains the paint to be injected into the can. A valve engaging member having a bore therethrough is threadably attached at one end thereof to the fill head and a first spring is received in the valve engaging member and biases a ball against an opening in the bottom of the working bore. The other end of the valve engaging member has a "male" tip formed thereon which is received within the bore in the "female" type discharge valve in the closure cap on the aerosol can, and depresses a valve body therein. The valve body is biased against the end of the "male" tip of the valve engaging member by a second spring. Compression of the paint by the piston within the working bore causes the ball within the fill head to depress the first spring permitting paint to pass through the opening in the fill head, through the bore in the valve engaging member into the "female" discharge valve, and around the valve member therein to fill the aerosol can. In this manner, paint or lacquer having a custom color can be readily injected into an aerosol can utilizing a "female" type discharge valve.

Accordingly, an object of the present invention is to provide an adapter for an aerosol can filling machine permitting the machine to be utilized to fill cans having a "female" type discharge valve.

Another object of the present invention is to provide an adapter for an aerosol can filling machine permitting the machine to be utilized to fill cans having a "female" type discharge valve, and wherein the adapter is readily interchangeable with a similar adapter for filling aerosol cans having a "male" type discharge valve.

A still another object of the present invention is to provide an adapter for an aerosol can filling machine permitting the machine to inject "custom" colors of paint or lacquer into cans having a "female" type discharge valve.

DESCRIPTION OF THE PREFERRED EMBODIMENT

Figure 1:
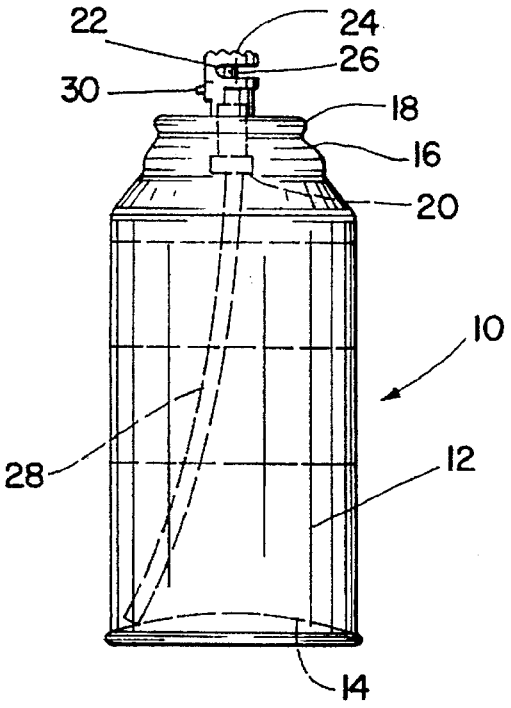
Fig. 1 (PRIOR ART)
FIG. 1 is a front elevational view of an aerosol can of a well-known type.

Referring now to the drawings where the illustrations are for the purpose of describing the preferred embodiment of the present invention and are not intended to limit the invention described herein, FIG. 1 is a front elevational view of an aerosol can 10 of a well-known type. Can 10 has a cylindrical body 12 and an upwardly convex bottom 14 which provides strength to the bottom to withstand the pressure within the can. The upper end of the can body 12 is reduced in diameter as at 16, leaving an opening which is closed by a closure cap 18 that is crimped and sealed to the upper edge of the can body 12.

Closure cap 18 supports a discharge valve 20 that may take any number of forms, a preferred form of a "male" type valve being illustrated in FIG. 1. The valve illustrated is normally closed but may be opened by means of a plastic actuating cap 22 having a hinged flap 24 that engages a valve actuating pin 26 when the flap 24 is depressed by the user. A flexible dip tube 28 is received within the can 10 and is attached to the underside of the valve 20. When the flap 24 is depressed by the user, the actuating pin 26 is also depressed causing the valve 20 to open allowing the pressure of the propellant gas within the can 10 to cause the contents of the can 10 to flow upwardly through the dip tube 28 and through the valve 20 to be discharged from a spray orifice 30 within the cap 22. Upon release of the flap 24, the actuating pin 26 rises causing the valve 20 to automatically close stopping the spraying of material from the can 10.

Figure 2:
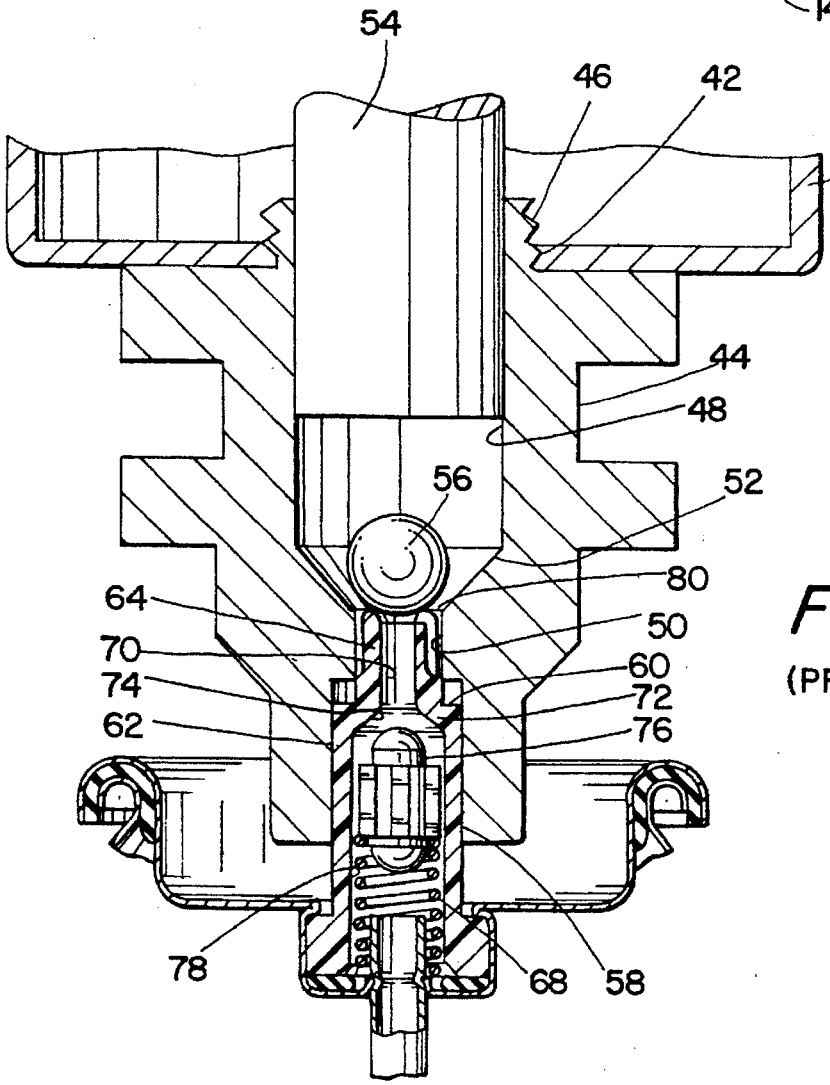
Fig. 2 (PRIOR ART)
FIG. 2 is a cross-sectional view of a fill head or adapter which can be utilized with a pneumatically operated filling machine and wherein the fill head is the appropriate design for filling an aerosol can having a "male" type discharge valve.

The cans 10 are charged with a desired amount of liquified propellant gas, such as hydrocarbon, at the factory before the cap 18 is crimped onto the upper edge of the can body 12. Alternatively, if the can 10 is to be utilized to spray paint, the propellant gas and the solvent can be placed within the can 10 before the cap 18 is crimped thereon, and the paint can be forced through the valve 20 by a pneumatically operated filling machine, such as that disclosed in U.S. Pat. No. 4,938,260 (Hirz). Such a pneumatically operated filling machine includes a paint reservoir 40 having a female threaded portion 42 protruding from the bottom surface thereof for attaching a fill head 44 thereto by threads 46 provided on the exterior of the inlet portion of the fill head 44, as shown in FIG. 2. The fill head 44 has a main working bore 48 and a first bore 50 interconnected by a conically tapered bore portion 52. A piston 54 is received within main working bore 48 and is movable therein by actuation of the filling machine. A ball 56 is received within conically tapered bore portion 52 and contacts the surface defining the junction of conically tapered ball portion 52 and first bore 50. First bore 50 terminates in a second bore 58 forming an annular shoulder 60 therebetween. Second bore 58 is larger than first bore 50 and is sized so as to surround the upwardly projecting portion 62 of the valve 20 during the filling process. Upwardly projecting portion 62 of valve 20 terminates in a reduced diameter portion 64 forming an annular shoulder 66 therebetween.

The discharge valve 20 has a first bore 68 therein that communicates with the dip tube 28, a second bore 70 within reduced diameter portion 64 of valve 20, and a conically tapered bore 72 which interconnects bores 68 and 70. The surface defining conically tapered bore 72 forms a valve seat 74 for a valve member 76 received within first bore 68. The valve member 76 is urged into sealing engagement with the valve seat 74 by a valve spring 78. The valve member 76 and valve seat 74 form a check valve that is normally closed to prevent discharge of the contents of the can, but which can be opened by the application of external pressure to the valve member 76 in excess of the pressure within the can, thereby permitting material to be injected into the can. During the filling process, the top 80 of the reduced diameter portion 64 of the valve 20 contacts the ball 56 displacing the ball 56 upwardly away from the surface defining the junction of conically tapered ball portion 52 and first bore 50 within the fill head 44. Downward movement of the head 44 after ball 56 is displaced upwardly is limited by shoulder 60 within head 44 contacting shoulder 66 on upwardly projecting portion 62 of valve 20. In practice, a pressure of several hundred pounds per square inch is required to force the valve member 76 out of sealing engagement with the valve seat 74 against the force applied by the valve spring 78. The use of head 44 in conjunction with a pneumatically operated filling machine, such as that disclosed in U.S. Pat. No. 4,938,260, can accomplish the filling of cans utilizing such a discharge valve 20.

Figure 3:
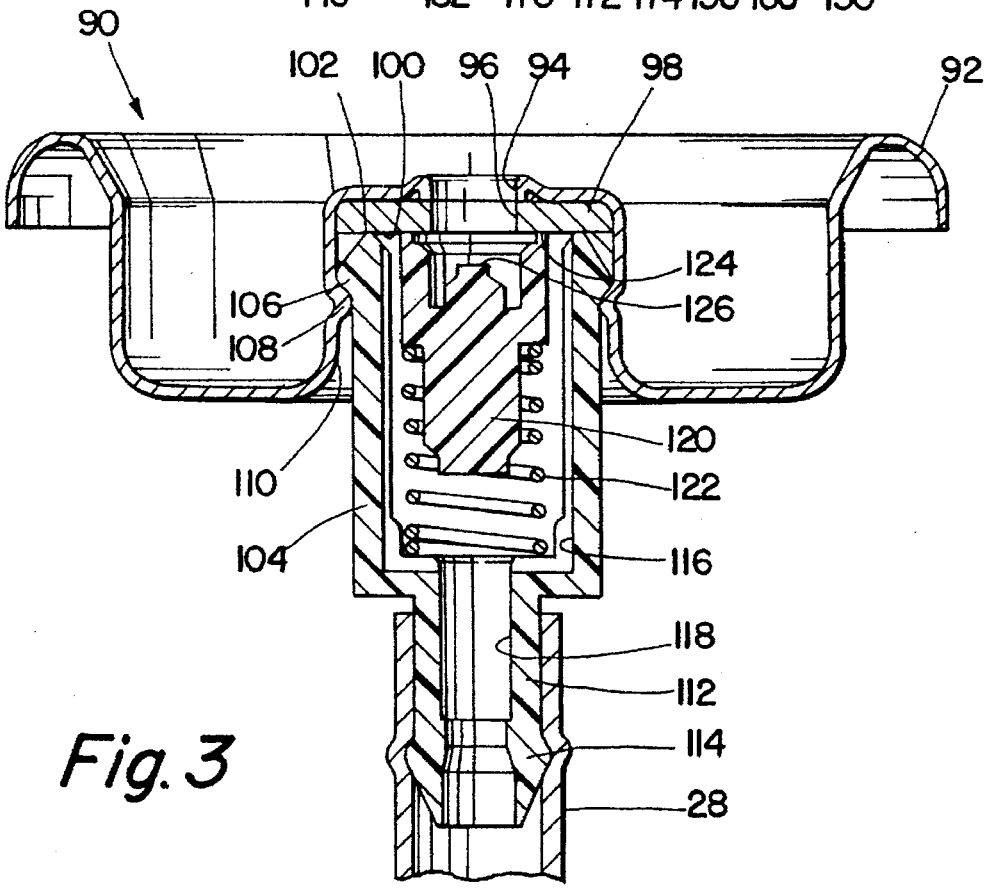
FIG. 3 is a cross-sectional view of a "female" type discharge valve.

A "female" type of aerosol can discharge valve has been developed which complements the "male" type discharge valve 20 just discussed. A typical "female" type discharge valve 90 is illustrated in FIG. 3. In this case, the closure cap 92 is crimped and sealed to the top of the can 10 and includes a bore 94 in the approximate center thereof. The bore 94 is aligned with a bore 96 in a gasket 98 provided on the underside of the closure cap 92. The underside 100 of gasket 98 contacts the top surface 102 of a cylindrical valve body 104 which is attached to the closure cap 92 by means of an annular circumferential rib 106 which is positioned inwardly of and captured by an annular circumferential rib 108 provided in a circumferential recess 110 in the closure cap 92. The outer end of the valve body 104 has a reduced diameter portion 112 which is received within the dip tube 28 and is captured therein by a annular circumferential rib 114. The valve body 104 has a blind bore 116 therein which is in fluidic communication with a through bore 118. A valve member 120 is received within blind bore 116 and is biased by a spring 122 so that the upper end 124 of valve member 120 contacts the underside 100 of gasket 98. The valve member 120 has a projection 126 in the approximate center thereof which contacts the apparatus utilized to fill the can, as hereinafter described.

Figure 4:
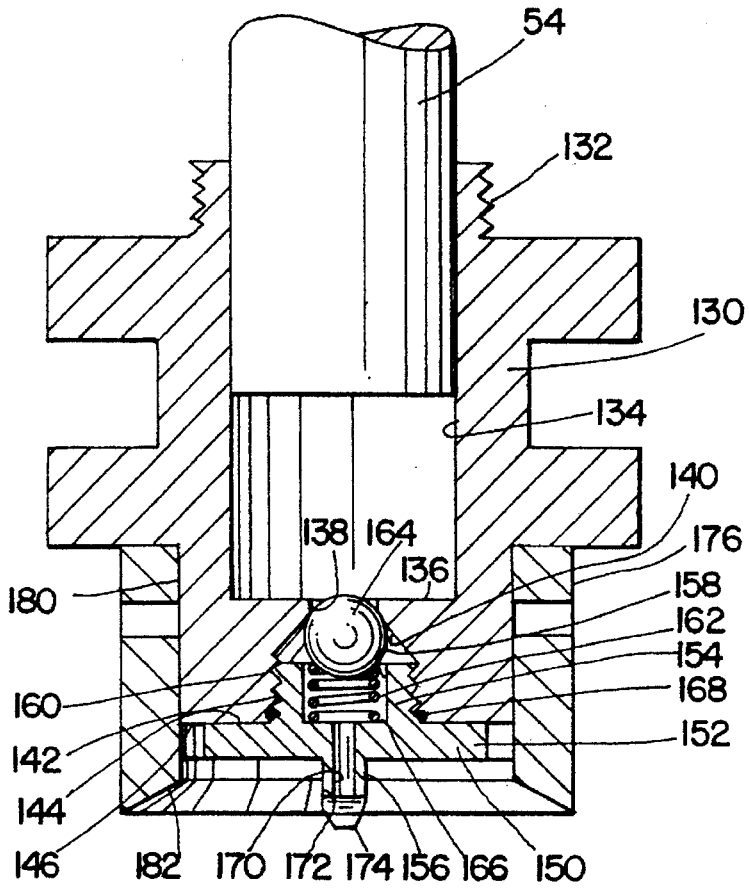
FIG. 4 is a cross-sectional view of the fill head or adapter of the present invention and which can be utilized for filling an aerosol cans having a "female" type discharge valve.

A fill head 130 which can be utilized to fill aerosol cans utilizing "female" type discharge valves is shown, in cross-section, in FIG. 4. In this case, the head 130 is attached to the female threaded portion 42 on the bottom surface of paint reservoir 40 by threads 132 provided on the exterior of the inlet portion to head 130. The head 130 has a working bore 134 therein which communicates at its bottom 136 with a smaller bore 138 which, in turn, communicates with an outwardly flared portion 140. Portion 140 terminates in a threaded portion 142 which, in turn, terminates in an outwardly flared circumferential recess 144 provided in end 146 of head 130. Piston 54 is received within working bore 134 and is movable therein by actuation of the filling machine. A valve engaging member 150 is provided and is comprised of base portion 152 interposed between a hub portion 154 and a male tip portion 156. Base portion 152 is sized so as to be receivable within closure cap 92 of "female" type discharge valve 90. Hub portion 154 has a blind bore 158 therein and threads 160 on the exterior surface thereof which engage threads 142 in head 130. A spring 162 is received within blind bore 158 and contacts a ball 164 at one end thereof and inner surface 166 of base portion 152 of valve engaging member 150 at the other end thereof. In this manner, ball 164 is biased by spring 162 against the surface defining the junction of outwardly flared portion 140 and smaller bore 138 of head 130. An O-ring 168 is provided within outwardly flared circumferential recess 144 in end 146 of head 130 and provides a seal between head 130 and base portion 152 of valve engaging member 150. A bore 170 is provided through base portion 152 and through a portion of male tip 156. Bore 170 is in fluidic communication with blind bore 158 and a cross bore 172 provided adjacent the end 174 of male tip 156 of valve engaging member 150. End 174 of male tip 156 is chamfered to assist in the insertion thereof in a "female" valve type discharge valve, as herein described. A circumferential housing 176 is provided over the end portion 178 of head 130 and is attached thereto by means of set screws (not shown) provided through housing 176. The circumferential housing 176 has a bore 180 therein which terminates in an outwardly flared portion 182.

Figure 5:
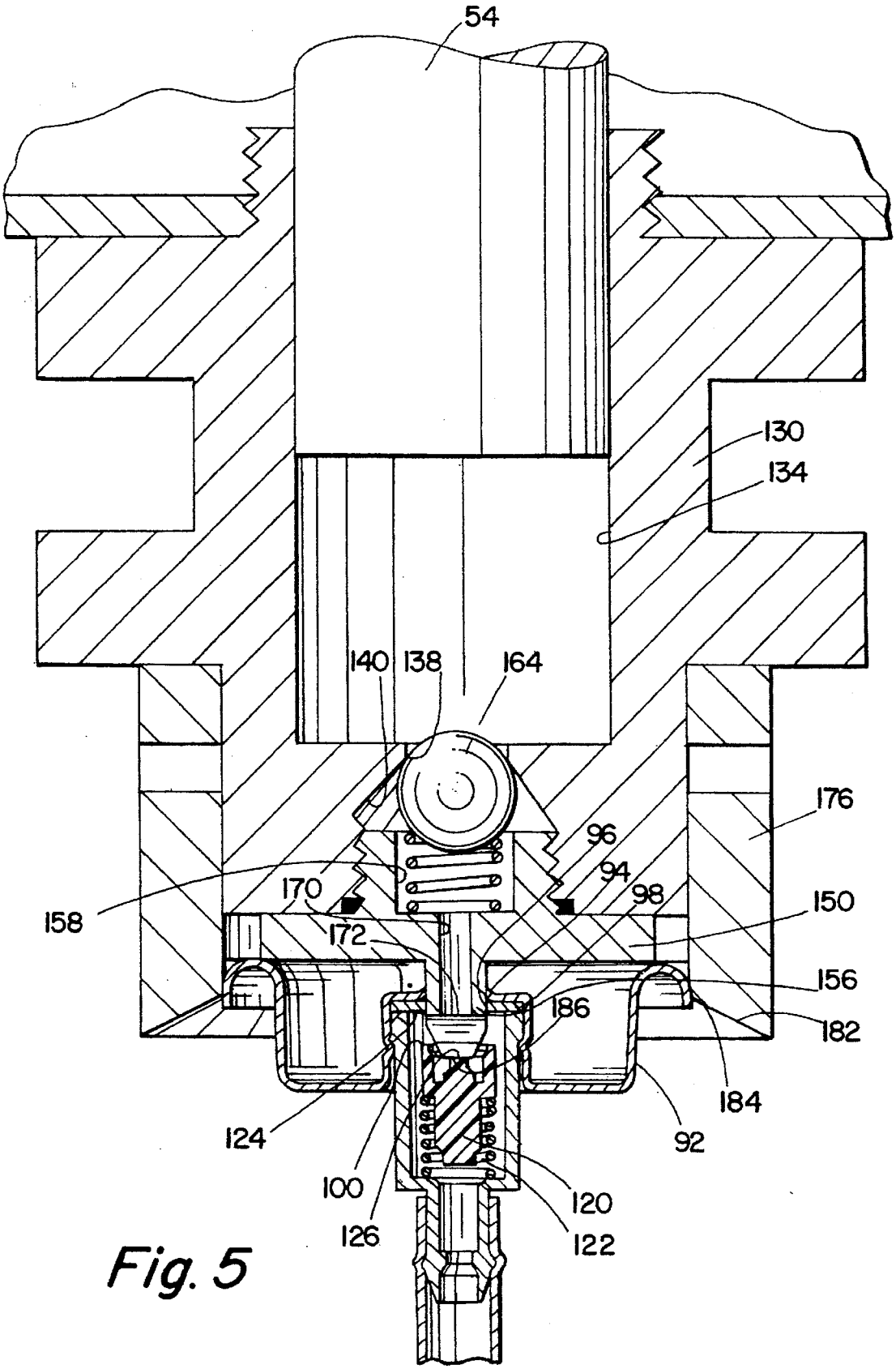
FIG. 5 is a cross-sectional view illustrating the filling of an aerosol can having a "female" type discharge valve and utilizing the fill head or adapter of the present invention.

Referring now to FIG. 5, the utilization of head 130 to fill an aerosol can having a "female" type discharge valve and utilizing apparatus similar to that disclosed in U.S. Pat. No. 4,938,260 is illustrated. In this case to fill an aerosol can utilizing a "female" type discharge valve such as that illustrated in FIG. 3, the head 130 is moved downwardly relative to the "female" type discharge valve permitting chamfered end 174 of male tip portion 156 of valve engaging member 150 to become aligned with bore 94 in cap 92. If cap 92 is substantially out of alignment with respect to head 130, the surface defining the outwardly flared portion 182 of circumferential housing 176 on fill head 130 contacts the outer periphery of the rolled edge 184 on closure cap 92 moving the cap 92 laterally with respect to the head 130 causing the male tip portion 156 of valve engaging member 150 to become aligned with bore 94 in cap 92. As base portion 152 of valve engaging member 150 is received within the closure cap 92, the male tip portion 156 of valve engaging member 150 is received through bore 94 in cap 92 and through bore 96 in gasket 98 and the end 174 of male tip portion 156 contacts projection 126 on valve member 120 causing the valve member 120 to be depressed against spring 122. The tension of spring 122 limits the downward movement of valve member 120, and thus, the similar downward movement of head 130. In this manner, the upper end 124 of valve member 120 becomes disengaged from the underside 100 of gasket 98. As piston 54 is depressed within bore 134, ball 164 becomes disengaged from the surface defining the junction of outwardly flared portion 140 and smaller bore 138 of head 130 allowing paint to flow into the can via working bore 134, smaller bore 138, outwardly flared portion 140, bore 158, bore 170 and cross bore 172. After the stroke of piston 54 has been completed and upon withdrawal of piston 54 from the bore 134, ball 164 is drawn into outwardly flared portion 140 so as to contact the surface defining the junction of outwardly flared portion 140 and smaller bore 138 preventing any paint from passing therethrough until the next piston stroke. When the piston 54 is fully withdrawn from bore 134, paint is again allowed to flow from the reservoir 40 into the bore 134 for the next stroke of the piston 54. In this manner, a controlled amount of paint can be inserted into the aerosol can without the dripping of any paint from the head 130.

Certain modifications and improvements will occur to those skilled in the art upon reading the foregoing. It should be understood that all such modifications and improvements have been deleted herein for the sake of conciseness and readability but are within the scope of the following claims.

We claim:

1. An adapter for an apparatus for filling aerosol cans utilizing a "female" type discharge valve, said female type discharge valve being in a normally closed condition and having a bore therein to receive a valve member, said adapter comprising a body member having a blind bore therein terminating in a fluid passageway; a one-way check valve in fluidic communication with said blind bore; a valve engaging member attached to said body member; said check valve being interposed between said valve engaging member and said fluid passageway from said blind bore in said body member; said valve engaging member having a male tip portion protruding therefrom for engagement with said valve member within said female type discharge valve, engagement of said male tip portion of said valve engaging member with said valve member within said female type discharge valve causing said female type discharge valve to open permitting material to pass through said adapter into said aerosol can as a piston is advanced within said body member of said adapter.

2. The apparatus as defined in claim 1 further including a sleeve member received over the end of said body member and positioned so as to surround said valve engaging member, said sleeve member having an outwardly flared end which contacts the aerosol can during the filling process.

3. An adapter for an apparatus for filling aerosol cans utilizing a "female" type discharge valve, said female type discharge valve being in a normally closed condition and having a bore therein to receive a valve member, said adapter comprising a body member having a blind bore therein terminating in a fluid passageway; a one-way check valve in fluidic communication with said blind bore; a valve engaging member attached to said body member; said check valve comprising a ball member in fluidic communication with said blind bore in said body member and a spring interposed between said valve engaging member and said ball member biasing said ball member against said body member closing said passageway from said blind bore, said valve engaging member having a male tip portion protruding therefrom for engagement with said valve member within said female type discharge valve, engagement of said male tip portion of said valve engaging member with said valve member within said female type discharge valve causing said female type discharge valve to open permitting material to pass through said adapter into said aerosol can as a piston is advanced within said body member of said adapter.

4. The apparatus as disclosed in claim 3 wherein said valve engaging member has a recess formed therein, said spring being positioned within said recess so as to bias said ball member against the surface defining said passageway from said blind bore.

5. The apparatus as defined in claim 3 wherein said valve engaging member includes a hub portion threadably attached to said body member, a male tip portion oppositely disposed from said hub portion, and a base portion interposed between said hub portion and said male tip portion.

6. The apparatus as defined in claim 5 wherein said hub portion has a recess formed therein to for receipt of said spring.

7. The apparatus as defined in claim 5 wherein said base portion and said male tip portion have a bore formed therein.

8. The apparatus as defined in claim 7 wherein said bore in said base portion and said male tip portion are in communication with a cross bore positioned adjacent the end of said male tip portion.

* * * * *

UNITED STATES PATENT AND TRADEMARK OFFICE

CERTIFICATE OF CORRECTION

PATENT NO. : 5,647,408

DATED : July 15, 1997

INVENTOR(S) : Erste et al.

It is certified that error appears in the above-identified patent and that said Letters Patent is hereby corrected as shown below:

At cover page [75] Inventors, "South Eclid" should be -- South Euclid --.

Signed and Sealed this

Fifth Day of September, 2000

*Attest:*

*Attesting Officer*

Q. TODD DICKINSON

*Director of Patents and Trademarks*